United States Patent [19]

Kirkby

[11] 3,942,340

[45] Mar. 9, 1976

[54] APPARATUS FOR WASHING AND LAUNDERING GARMENTS

[75] Inventor: Christopher Armstrong Kirkby, Kendal, England

[73] Assignee: Ibis Engineers Limited, Kendal, England

[22] Filed: July 5, 1974

[21] Appl. No.: 486,103

[30] Foreign Application Priority Data

July 9, 1973 United Kingdom ..... 32662/73

[52] U.S. Cl. ..... 68/3 R; 68/10; 68/20; 68/205 R

[51] Int. Cl.[2] ..... D06F 31/00

[58] Field of Search ..... 68/3 R, 10, 20, 205 R; 99/443 C, 261

[56] References Cited

UNITED STATES PATENTS

| | | | |
|---|---|---|---|
| 1,220,308 | 3/1917 | Young et al. | 68/10 |
| 2,138,813 | 12/1938 | Bemis | 99/443 |
| 3,550,169 | 12/1970 | Forse | 68/3 R |
| 3,686,899 | 8/1972 | Rosenfeld et al. | 68/3 R |

*Primary Examiner*—Harry N. Haroian
*Attorney, Agent, or Firm*—Norris & Bateman

[57] ABSTRACT

A machine for washing and laundering garments on hangers comprises a substantially vertical conveyor for lifting a garment on a hanger, transferring the hanger to a stationary conveyor along which it travels at two speeds through spraying chambers and dripping chambers, a transfer pulley to transfer the hanger from the stationary conveyor to an endless conveyor, further spraying chambers, and dripping chambers through which the hanger passes to a drying chamber to dry the garment on the hanger or set a coating thereon.

8 Claims, 14 Drawing Figures

APPARATUS FOR WASHING AND LAUNDERING GARMENTS

This invention relates to improvements in apparatus for washing and laundering garments on hangers and also to such machines where the garments are subjected to a treatment with a water soluble detergent solution applied to the garment and dried thereon to provide a protective coating and which is subsequently laundered to remove the coating and recoated for subsequent use.

A process has been proposed in which a water soluble detergent solution has a pH value not greater than 6 is applied to the garment and the garment is then dried by heat treatment to produce a pliable protective coating on the garment resistant to soiling and which is removable from the fabric of the garment with any dirt by rinsing in clean water.

It has also been proposed to launder garments hanging on hangers such apparatus being continuously operable and including a conveyor for conveying successive garments on hangers with the widths of the hanging garments aligned with the direction of travel, a series of successive spray stations in a washing zone through which, in use, the garments are successively conveyed and including at least one wash spray station and one rinse spray station, each said spray station being adapted to direct a liquid spray transverse to the direction of travel against the backs and/or fronts of the successive garments such that relative movement between garments and sprays causes agitated movement of garments portions to assist in thoroughly subjecting the garments to said sprays.

According to the invention a machine for washing and laundering garments on hangers comprises a substantially vertical conveyor for lifting a garment on a hanger, transferring the hanger to a traversing conveyor along which it travels at two speeds through spraying chambers and dripping chambers, a transfer pulley to transfer the hanger from the stationary conveyor to an endless conveyor, further spraying chambers, and dripping chambers through which the hanger passes to a drying chamber to dry the garment on the hanger or set a coating thereon.

The invention will be described with reference to the accompanying drawings.

Figure 4:
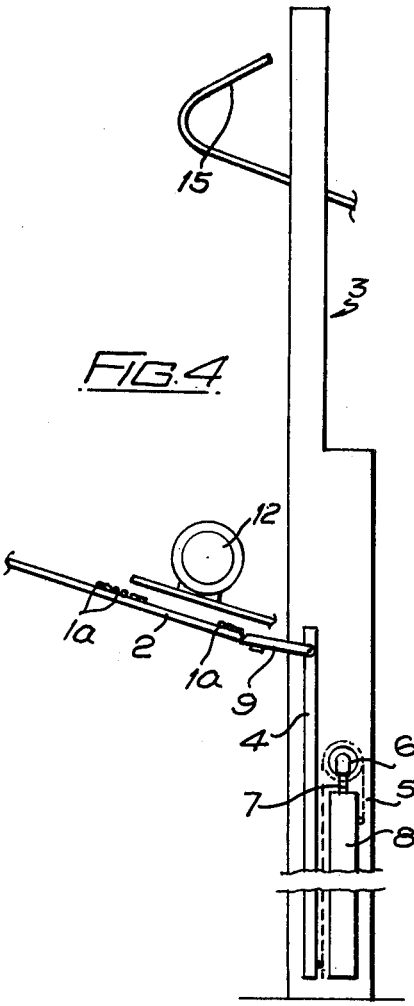
FIG. 4 is an elevation of the feed mechanism for the machine showing a hoist in the lower position.

Garments on hangers are placed on an inclined garment rail 2 in the loading area and are lifted one at a time by a hoist 3 (FIG. 4). The hoist 3 comprises a vertical rod 4 sliding in guides therein the lower end of the arm being connected by a chain or cord 5 passing over a pulley 6 to a piston rod 7 of an hydraulic cylinder 8. A spring loaded arm 9 is pivoted on the rod 4 as it reaches the lowered position (FIG. 4) engages a lever 11, pivoted on the garment rail 2.

Figure 5:
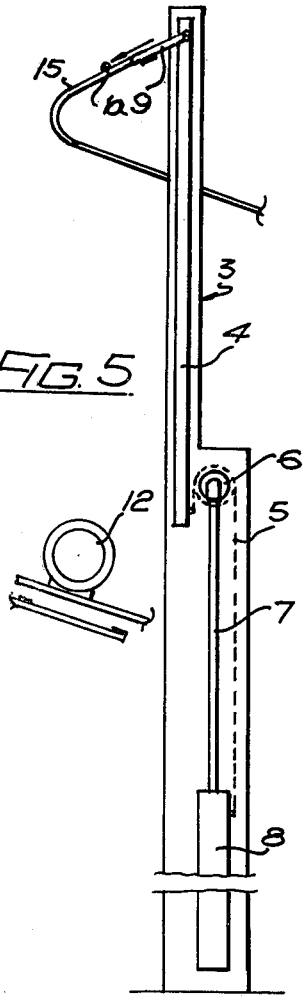
FIG. 5 is a similar elevation showing the hoist in the raised position.
Figure 6:
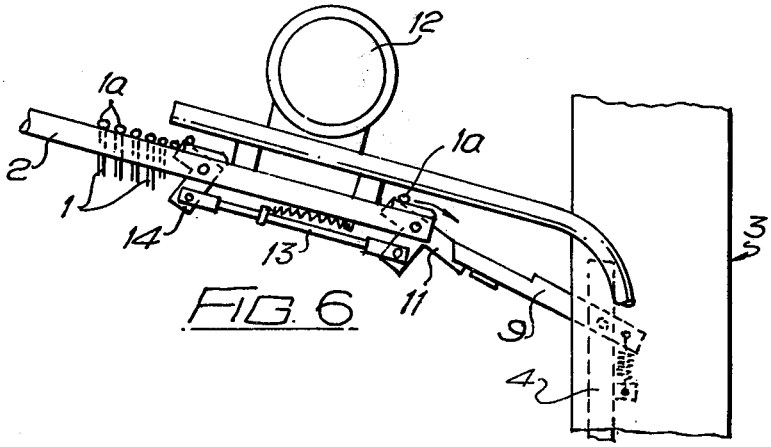
FIG. 6 is a detailed elevation showing the mechanism for transferring the hangers to a slick rail.

The garment Rail 2 is inclined (FIG. 6) at such an angle that the hangers 1 will not slide down and a vibrator 12 is mounted on the rail to cause the hangers to move down. The pivoting of the lever 11 which is connected by a spring loaded rod 13 to a second lever 14 pivoted on the rail 2 causes the arm 9 in the lowered position FIG. 6 to rock the lever 11 and a hanger 1 is released and moves onto the arm 9; at the same time a further hanger 1 is released by the lever 14 from the rail 2 and moves to the lever 11 for release therefrom when the arm 9 again reaches the lowest position. The arm 9 with a hanger thereon is raised with the rod 4 by the cylinder 8 and at the end of the stroke the arm 9 contacts a slick rod 15 and is tipped against the action of the spring to allow the hanger to slide off the arm onto the slick rod (FIG. 5)

In order to remove any coating from the garments undergoing laundering the hangers sliding down the slick rod 15 are fed to a traversing channel shaped conveyor 16. The conveyor 16 is formed with a plurality of equally spaced notches 16*a* to receive the hangers from the slick rail 15. A piston rod 17 of a pneumatic cylinder 18 extends into the channel of the notched conveyor 16 and is provided with a plurality of pawls 21 pivoted thereon with their forward ends spaced apart a distance equal to the spacing of the notches 16*a*.

The stroke of the cylinder 18 is also substantially equal to the spacing of the notches and on the outward stroke of the piston the pawls engage a hanger 1 in each of the notches and carry them forward step by step one notch on the conveyor 16 and deposit them in a succeeding notch. The last pawl moves the forward hanger onto a second traversing conveyor 22. The second conveyor is positioned so that if for example the stroke of the piston is a length A (FIG. 7) the pawl 21a only moves the pawls 23 a distance B and therefore the hangers on the conveyor 22 are only advanced a distance B between the notches 24. On the return stroke of the piston the pawls 21, 21*a*, 23, travel back and pivot under the hangers in the next rearward notch to be in position to move a succeeding hanger forward on the next stroke of the piston, the pawls 23 being returned by a spring 25.

During the passage of the hangers 1 along the conveyor 16 the conveyor passes through a chamber 26 provided with activation sprays 27 which spray the garment on both sides, to wet out the garment. A roller 28 is provided transversely of the compartment over which the garment on the hanger 1 passes in order to turn the garment wrong side up as it passes over to tip any liquid from the pockets. On passing from the conveyor 16 onto the conveyor 22 the hangers 1 enter a drip chamber 29.

Figures 7, 8, 9, 11:
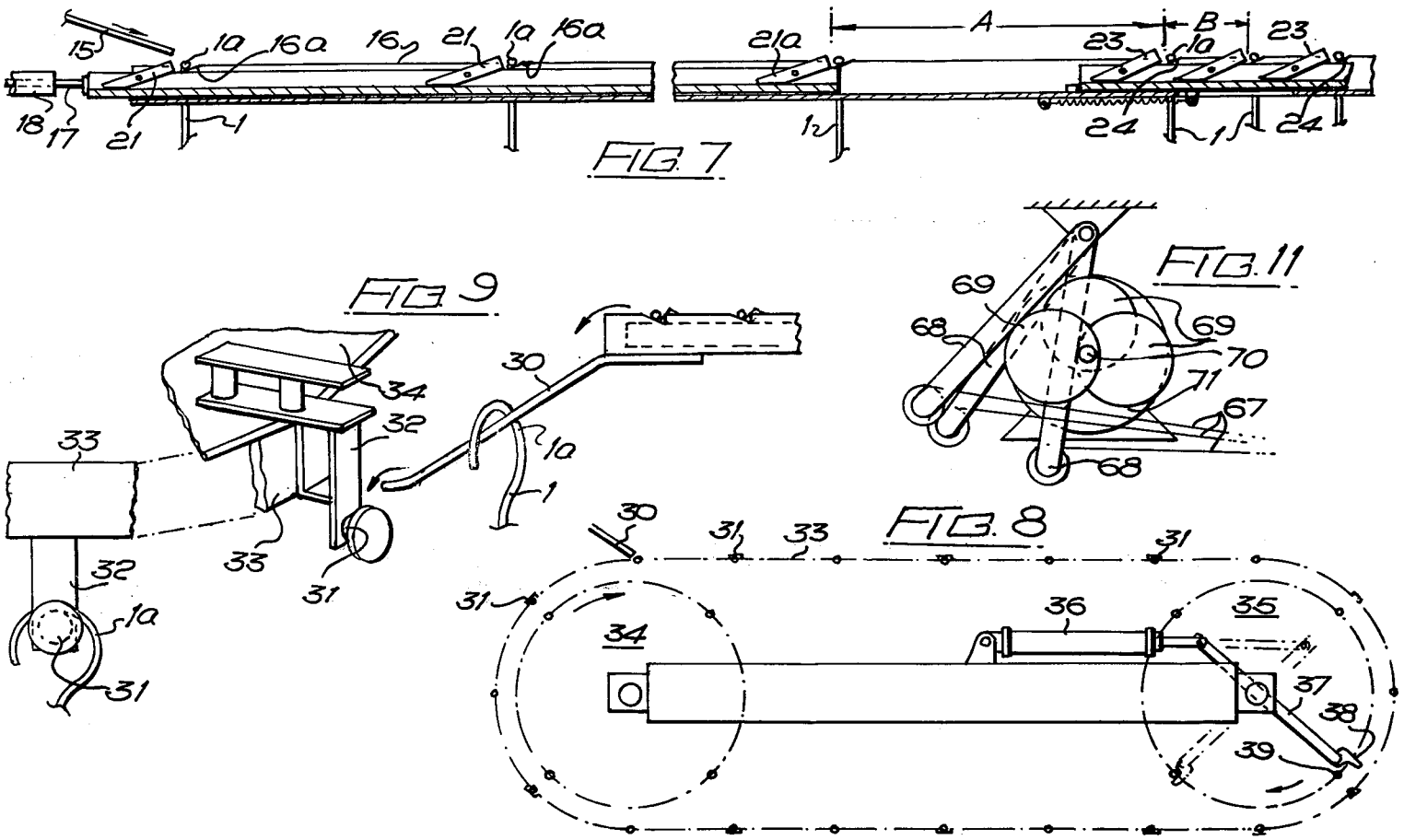
FIG. 7 is a detail elevation partly in section of one of the traversing conveyors.
FIG. 8 is a diagramatic plan of an endless conveyor.
FIG. 9 is a detail perspectrol view showing the transfer of a hook from the slick rail to the endless conveyor.
FIG. 11 is a detail view showing the mechanism for raising and lowering the jet frames.

The hangers are pushed off the end of the conveyor 22 by the last pawl 23 into a slick rod 30 and are deposited on a pin 31 having a button head mounted on arms 32 carried by an endless slat conveyor 33 passing over two drums 34,35 (FIG. 9).

The drum 35 is rotated intermittently by a pneumatic cylinder 36 actuating an arm 37 loosely mounted on the drum spindle and provided with a pawl 38 which engages one pair of a plurality of pins 39 at each stroke of the piston and on the return stroke moves back to engage a further pair to move the slat conveyor step by step.

The slat conveyor 33 travels through a plurality of compartments 40,41 in which the garments on the hangers are subjected to further sprays of detergent and rinse or allowed to drip. Filters 42 may be provided below the washing compartments through which the liquid passes to tanks 43 and a tray 44 in the drip chambers which discharge into tanks 45. A roller 46 is provided in the drip chambers over which the garment passes on the hanger to turn the garment wrong side up to empty any liquor from the pockets.

The hangers then pass over the second pulley 35 and travel back through further spray and drip chambers 40,41 and are removed from the slat conveyor 33 before the conveyor travels over the pulley 34.

Figure 10:
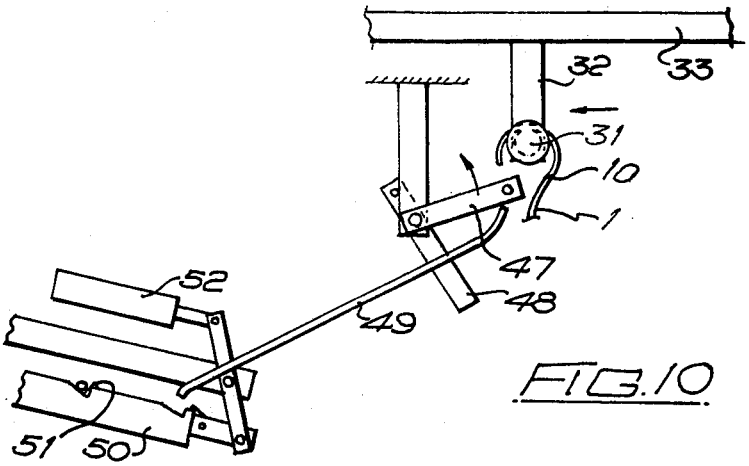
FIG. 10 is a detail view showing the mechanism for removing the hangers from the endless conveyor.
Figure 12:
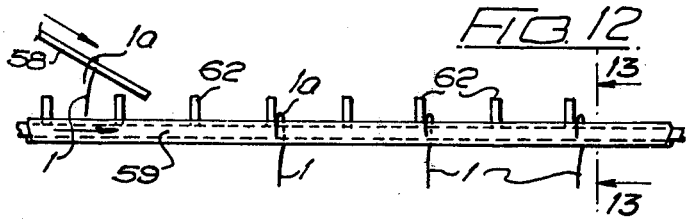
FIG. 12 is a detail view showing hanger being fed on to a second endless conveyor for passage through a dryer.

The hooks 1*a* of the hangers 1 are lifted off the button headed pins 31 before the conveyor 33 passes over the sprocket 34 by a pivoted arm 47 on the frame of the machine. The arm 47 is counter weighted by an arm 48 and as a hanger hook engages the arm 47, the arm is raised in the direction of the arrow FIG. 10 and lifts the hook off the pin 31 and allows the hanger to drop onto a slick rail 49 which deposits the hanger on a further stationary notched conveyor 50 the pawls 51 of which are operated by a pneumatic cylinder 52.

The hangers on the conveyor 50 travel through a further chamber 53 to drip down a slick rail 54 along a further notched conveyor 55 operated by a pneumatic cylinder 56 and pass through a chamber 57 to receive a new texturizing coating on their way to a slick rail 58 which deposits the hangers on an endless conveyor 59 on which they are carried through a drying chamber 60.

Figure 13:
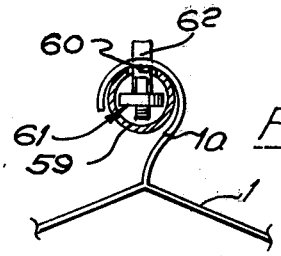
FIG. 13 is a section on line 14—14 FIG. 13.
Figure 14:
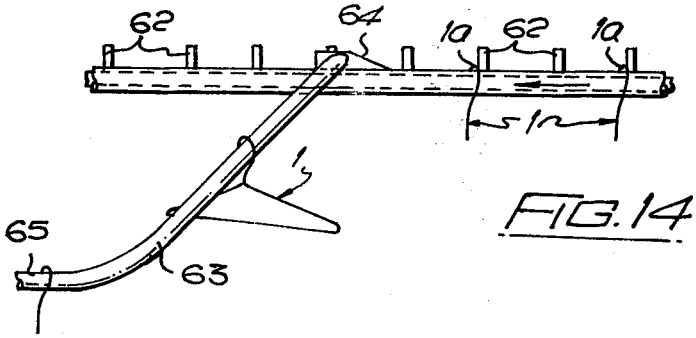
FIG. 14 is detail view showing a hanger being removed from the conveyor on emerging from the dryer.

The endless conveyor 59 (FIG. 13) is formed with a tubular casing having a slot 60 therein, a flexible member 61 having pegs 62 extending through the slot 60 passes through the casing 59. The hangers are moved over the casing 59 by the pegs 62.

The hangers are removed from the conveyor 59 by a ramp 64 on a slick rail 63 up which a hanger rides and by which the hook is lifted and deposited on the slick rail 63 down which the hangers slide into an unloading position 65.

If the garments are not to be protectively coated the hangers may pass directly from the slick rail 49 to the drying chamber 60.

Figure 1:
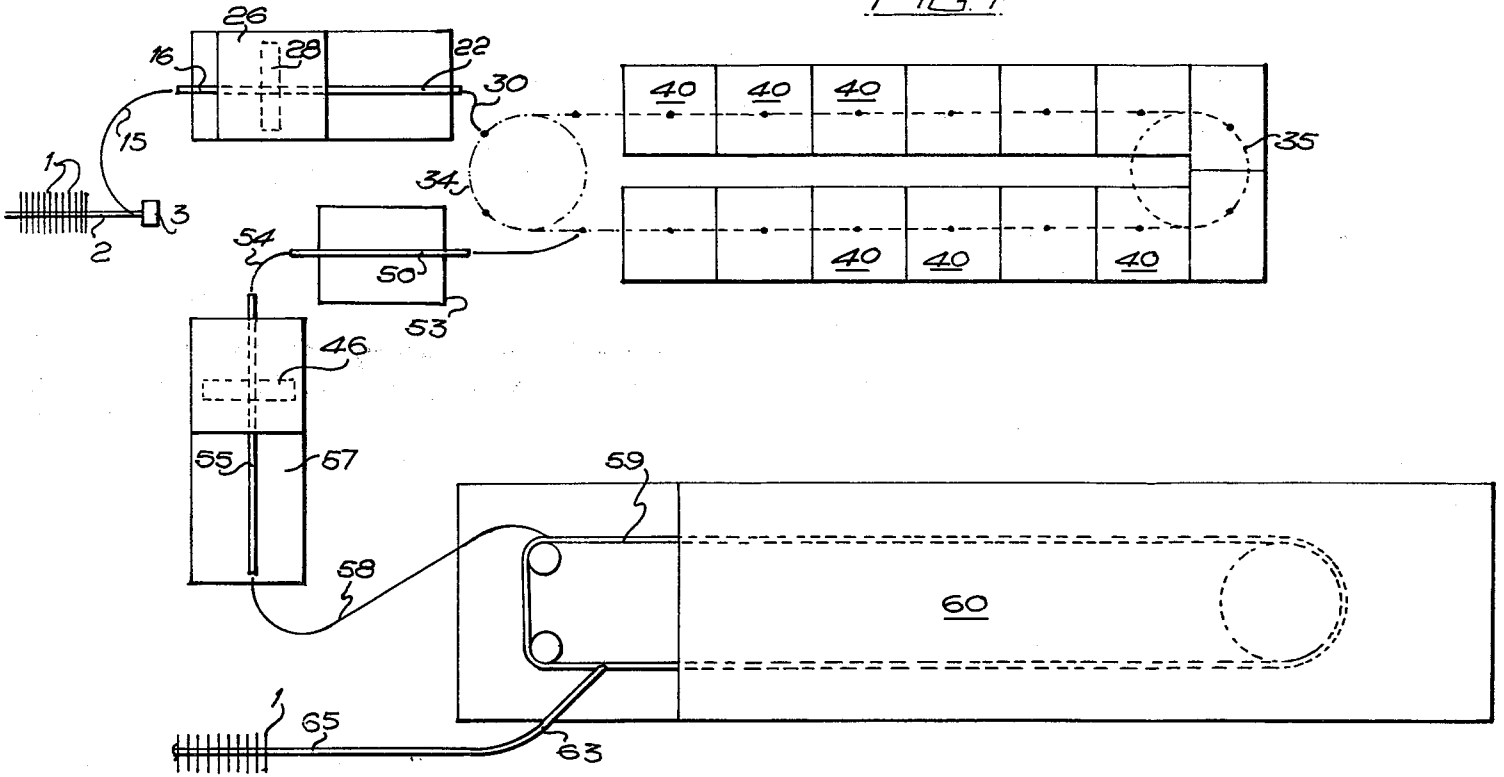
FIG. 1 is a diagramatic plan of a garment laundering process machine.
Figure 2:
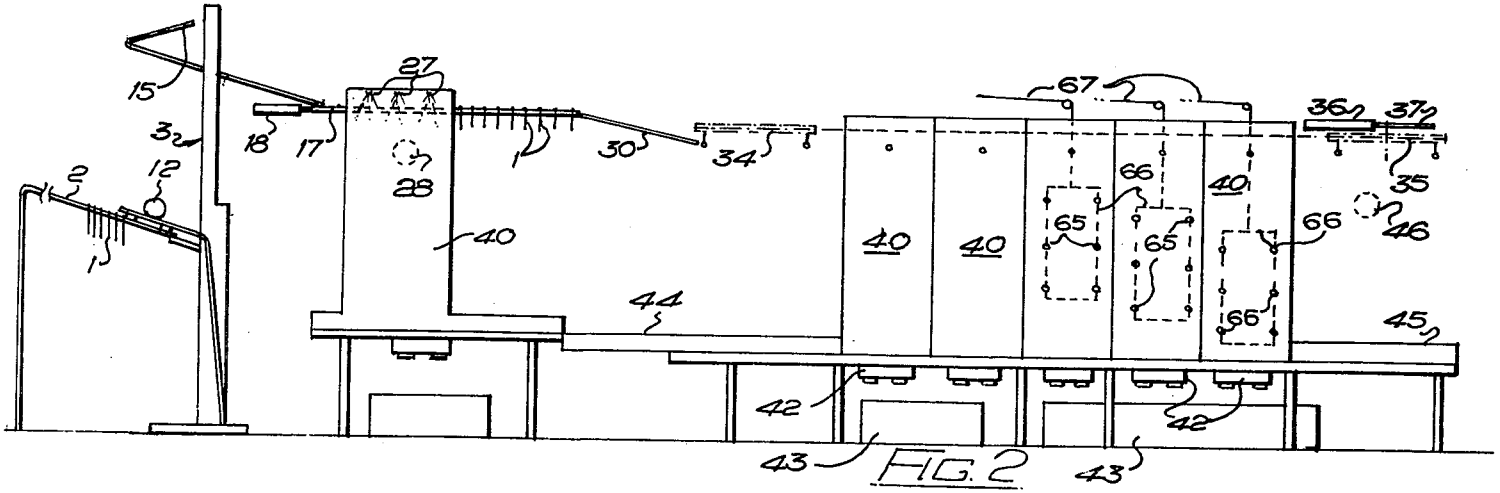
FIG. 2 is a diagramatic elevation of one side of the machine.
Figure 3:
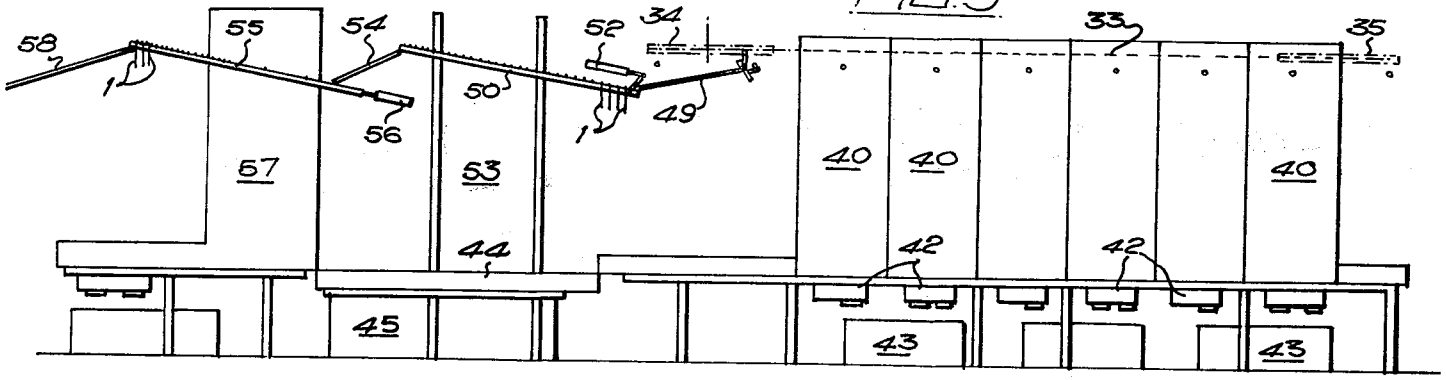
FIG. 3 is a diagramatic elevation of the return side of the machine.

The sprays 65 (FIG. 2) mounted on frames 66 in each chamber 40 each frame 66 being connected by a cable 67 to a pivoted arm 68 (FIG. 11) moved by an eccentric 69 on a shaft 70 driven by a motor 71 to impart a vertical up and down movement to the frames to distribute the spray over the garment. The spray frames in the chamber are connected to separate arms 68 arranged at 120°to equalise the load on the motor 71. The weight of the frames may be substantially spring balanced.

All the pneumatic cylinders actuating the conveyors to traverse the hangers are operated in synchronism.

The apparatus may be employed for continuously laundering garments on hangers as they pass through the spraying and dripping chambers some of which spray the garments with detergent and other chemicals whilst others spray them with rinsing water.

Where garments have been previously coated with a protective coating as described in British Pat. No. 1211734 the initial sprays remove the previous texturizing coating and the final sprays apply a new texturizing coating thereto.

What I claim is:

1. Apparatus for processing garments on hangers comprising means for transferring hangers each carrying a garment to be processed from a supply region where the hangers are randomly relatively closely grouped onto traversing conveyor means with successive hangers disposed in spaced relationship along said conveyor means, a treatment station embodying successive liquid spray and drip compartments, means for intermittently advancing said hangers along said conveyor means at relatively different speeds in the respective chambers, and means for extracting said hangers from said conveyor means and passing them through subsequent treatment stations.

2. Apparatus for processing garments on hangers comprising traversing conveyor means, means for transferring hangers each carrying a garment to be processed from a supply region where the hangers are randomly but relatively closely grouped to said conveyor means including means for extracting said hangers one at a time from said supply and disposing them in spaced relation along said conveyor means, means for intermittently advancing said hangers along said conveyor means, means providing a first processing station wherein said hangers on said conveyor means are passed through liquid spray and drip compartments, means transferring said hangers in turn from said conveyor means to an endless conveyor, means providing a second processing station wherein said hangers on the endless conveyor pass through further liquid spray and drip compartments, means subsequently transferring said hangers to further conveyor means, and means providing a drying chamber through which the hangers move on said further conveyor means.

3. The apparatus defined in claim 2, wherein said traversing conveyor means is arranged at a higher level than said supply, and said means for transferring the hangers from said supply comprises hoist means for lifting said hangers to said traversing conveyor means one at a time.

4. The apparatus defined in claim 2, wherein said traversing conveyor means comprises fluid pressure actuated means connected to drive a reciprocable member having spaced pivoted pawls therealong for engaging and advancing said hangers when moving in one direction.

5. The apparatus defined in claim 2, wherein said endless conveyor is mounted on spaced drums, and intermittent drive means is connected to one of said drums.

6. The apparatus defined in claim 2, wherein said hangers are mounted on a downwardly inclined rod in the supply so that they tend to slide toward said means for transporting them to the traversing conveyor.

7. The apparatus defined in claim 6, wherein vibrator means is provided for said rod to aid said downward movement of said hangers.

8. Apparatus as defined in claim 2, wherein means is provided for periodically raising and lowering spray devices in the spray chambers.

* * * * *